US009429334B2

(12) United States Patent
Castillo et al.

(10) Patent No.: US 9,429,334 B2
(45) Date of Patent: Aug. 30, 2016

(54) HVAC PERSONAL COMFORT CONTROL

(75) Inventors: Daniel Castillo, Plano, TX (US); Bobby DiFulgentiz, Frisco, TX (US); Tom Kerber, Plano, TX (US); Doug Young, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 701 days.

(21) Appl. No.: 13/269,418

(22) Filed: Oct. 7, 2011

(65) Prior Publication Data

US 2013/0087630 A1 Apr. 11, 2013

(51) Int. Cl.
*G05D 23/02* (2006.01)
*F24F 11/00* (2006.01)

(52) U.S. Cl.
CPC ..... *F24F 11/0008* (2013.01); *F24F 11/006* (2013.01); *F24F 11/0012* (2013.01); *F24F 11/0015* (2013.01); *F24F 11/0086* (2013.01); *F24F 2011/0063* (2013.01); *F24F 2011/0091* (2013.01); *Y10T 29/4935* (2015.01)

(58) Field of Classification Search
CPC ..... F24F 11/0012; F24F 11/0015; F24F 11/006; F24F 2011/0061; F24F 2011/0063; F25B 2700/02; G05D 22/00; G05D 22/02
USPC ..... 236/44 C, 44 R; 62/176.6, 176.1
See application file for complete search history.

(56) References Cited

U.S. PATENT DOCUMENTS

| | | | | |
|---|---|---|---|---|
| 2,142,593 | A * | 1/1939 | Woodling | 165/223 |
| 4,475,504 | A * | 10/1984 | Mizuno | 477/111 |
| 5,737,934 | A * | 4/1998 | Shah | F24F 11/0008 165/223 |
| 5,810,078 | A * | 9/1998 | Knutsson et al. | B60H 1/00735 165/202 |
| 6,012,296 | A * | 1/2000 | Shah | 62/173 |
| 6,951,998 | B2 * | 10/2005 | Nanno et al. | 219/494 |
| 2007/0144189 | A1 * | 6/2007 | Ishida et al. | 62/157 |
| 2011/0168792 | A1 * | 7/2011 | Riley, Jr. | F24F 11/006 236/44 C |

* cited by examiner

*Primary Examiner* — Jonathan Bradford
(74) *Attorney, Agent, or Firm* — Baker Botts L.L.P.

(57) ABSTRACT

A heating ventilation and cooling system includes a cooling source and/or a heating source, and a controller. The cooling and/or heating sources are configured to respectively cool and heat an enclosed space. The controller is configured to receive an apparent temperature set point. The controller is further configure to operate the cooling and/or heating sources to maintain an absolute air temperature that is different from the apparent temperature set point.

12 Claims, 7 Drawing Sheets

HVAC PERSONAL COMFORT CONTROL

TECHNICAL FIELD

This application is directed, in general, to climate control, and, more specifically, to climate control systems and methods of operating such systems.

BACKGROUND

Climate control systems may take different forms depending on the application. In a residential or commercial building, for example, typically a heating, ventilating and air conditioning (HVAC) system is used to heat and/or cool the air within the building. In automobiles, cooling may be provided by an engine-driven compressor, and heating may be provided by a heat exchanger that warms the passenger cabin with engine-warmed coolant. In either case, climate control may be provided by a controller that modulates the duty cycle of the cool air source and/or the warm air source. In some cases, the controller may also control the humidity in the conditioned space. The comfort perceived by an occupant of the conditioned space is typically a function of both an absolute temperature (e.g. a dry-bulb temperature) and the relative humidity.

SUMMARY

One aspect provides a climate control system that includes a cooling source and/or a heating source, and a controller. The cooling and/or heating sources are configured to respectively cool and heat an enclosed space. The controller is configured to receive an apparent temperature set point. The controller is further configured to operate the cooling and/or heating sources to maintain an absolute air temperature within the enclosed space that is different from the apparent temperature set point.

Another aspect provides a method of manufacturing an HVAC system. The method includes in one step configuring a cooling source and/or a heating source to respectively cool and heat an enclosed space. In another step a controller is configured to receive an apparent temperature set point and to operate the cooling and/or heating sources to maintain an absolute air temperature within the enclosed space that is different from the apparent temperature set point.

Yet another aspect provides a climate control system. The system includes a cooling source and/or a heating source, and a controller. The cooling and/or heating sources are configured to respectively heat and cool an enclosed space. The controller is configured to display in lieu of a numerical value a non-alphanumeric icon representative of an apparent temperature set point. The controller is further configured to operate the cooling and/or heating sources to maintain air within the enclosed space at the apparent temperature set point.

BRIEF DESCRIPTION

Reference is now made to the following descriptions taken in conjunction with the accompanying drawings, in which.

Figure 1:
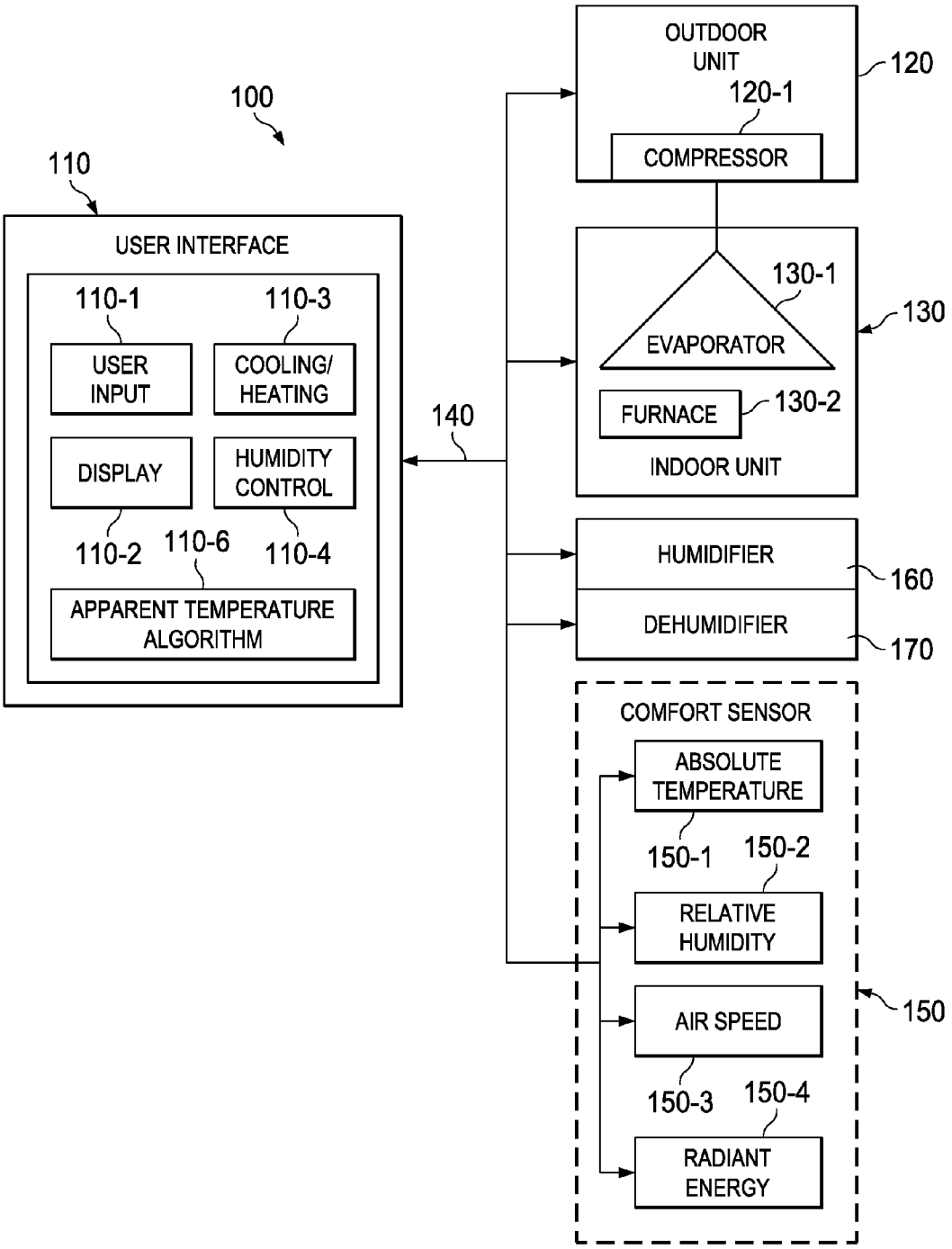
FIG. 1 illustrates a climate control system according to one embodiment, including a control layer of a user interface (controller) configured to operate the system to maintain an apparent temperature.
Figure 6:
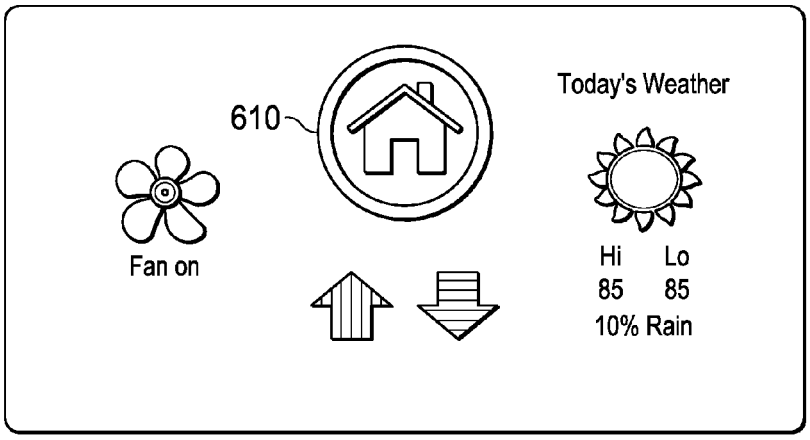
Figure 5:
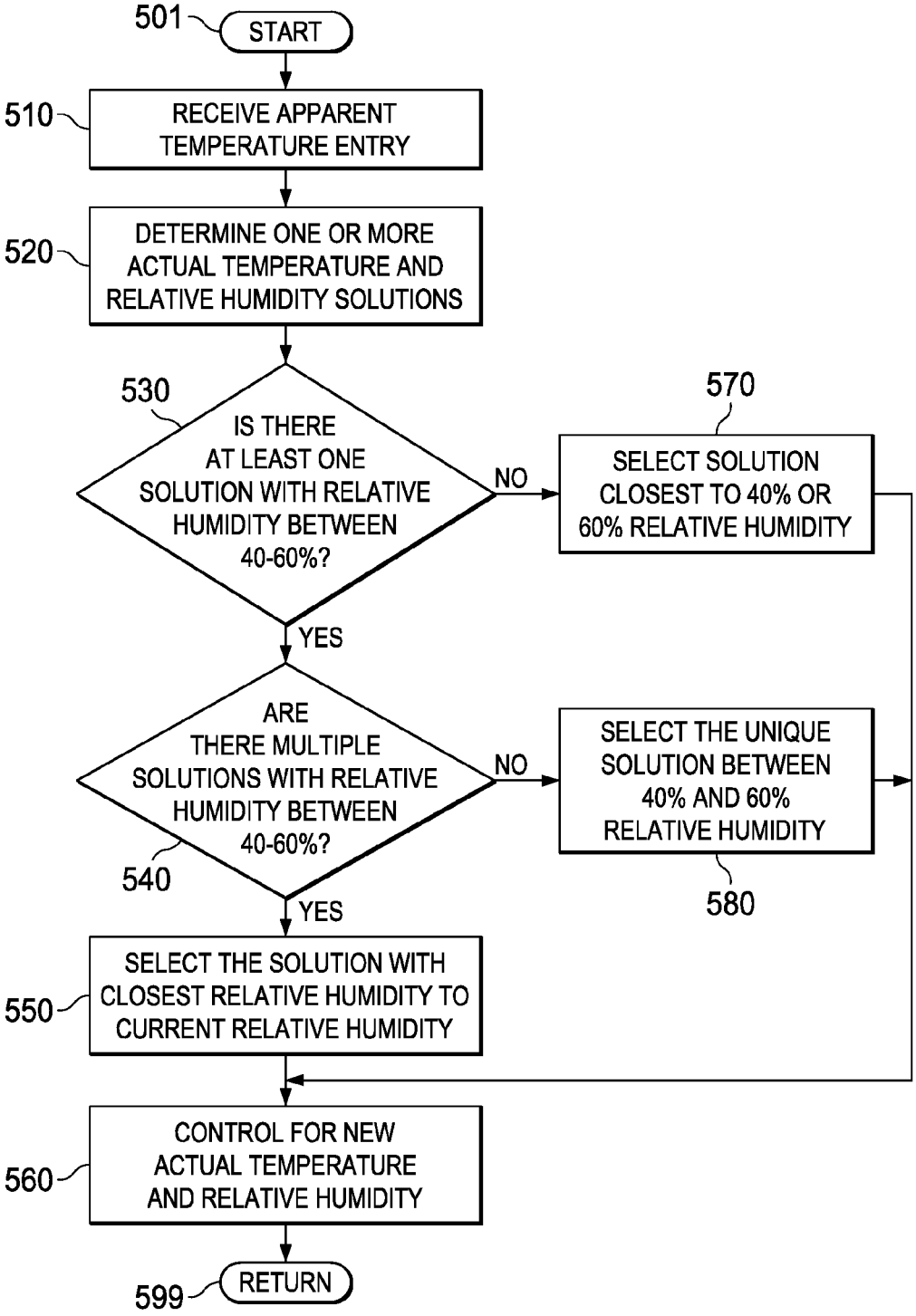
Figure 7:
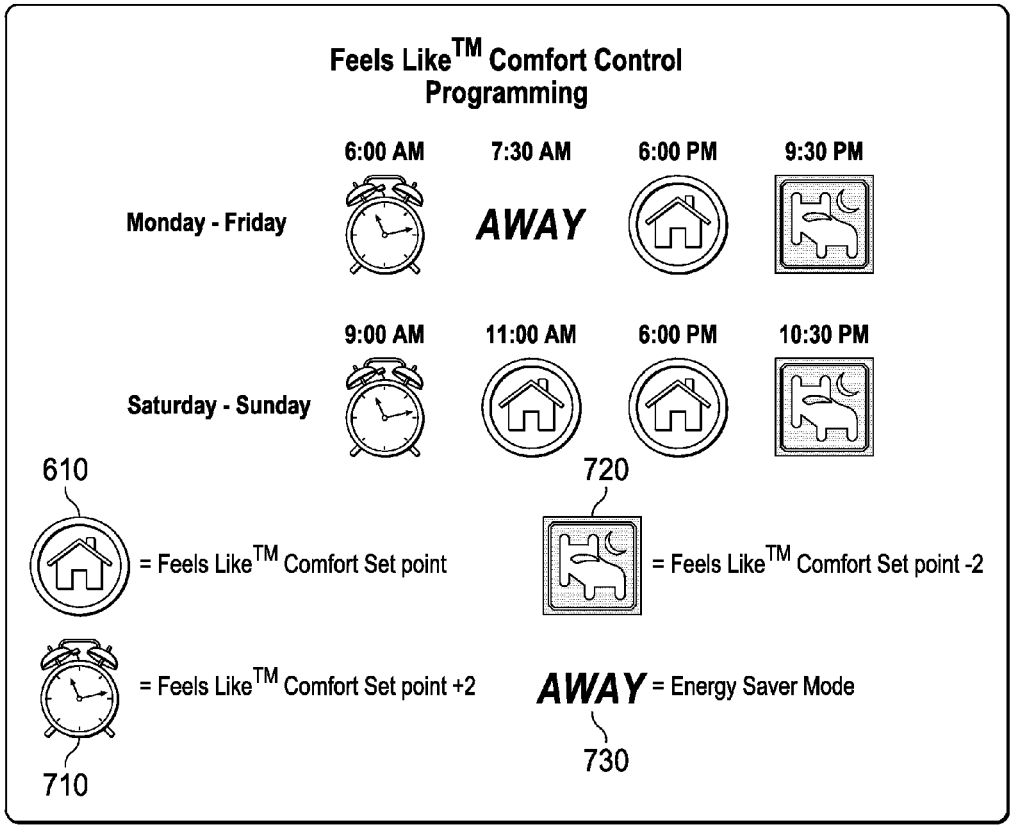
Figure 8:
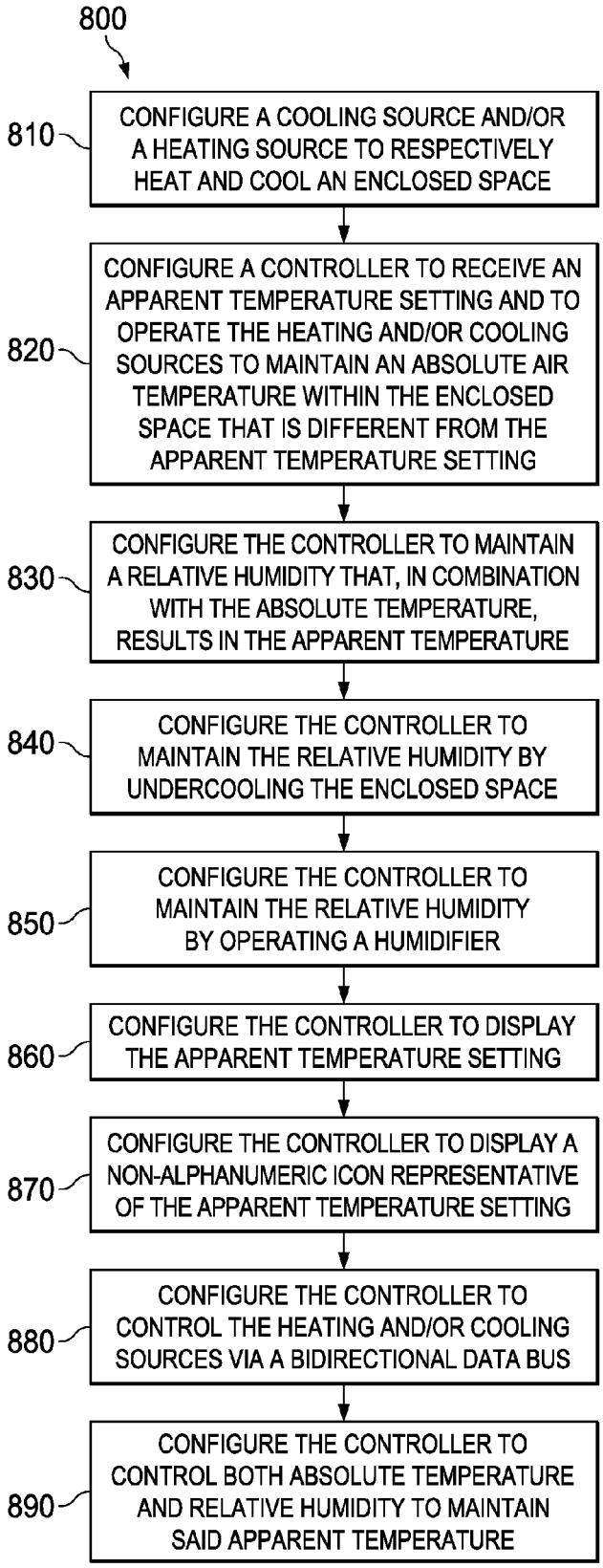

FIG. 5 presents a method of operating the system of FIG. 1 according to one embodiment;

FIGS. 6 and 7 illustrate example displays of the user interface display in which a selected apparent temperature is represented by a non-alphanumeric icon; and FIG. 8 illustrates a method of manufacturing a climate control system in one embodiment, e.g. the system of FIG. 1.

DETAILED DESCRIPTION

In the following discussion and in the claims, the following terms have following associated meanings:

Relative humidity (RH): the ratio of the partial pressure of water vapor in the air to the saturation vapor pressure of water vapor at the pressure and temperature of the air.

Absolute temperature ($T_a$): a measure of the temperature of air without regard to the relative humidity thereof. As an example, a dry-bulb thermometer provides a measure of absolute temperature.

Apparent temperature (AT): a value that describes human physiological perception of comfort in a conditioned (heated and/or cooled) space, the value taking into account both $T_a$ and RH.

Depending on the RH, heat loss can cause a person to feel warmer or colder than the absolute temperature alone would suggest. Thus, apparent temperature is sometimes referred to as a "feels like" temperature, may be equivalently referred to herein without loss of generality. However, some operators of a climate control system, e.g. homeowners, may not have an interest or the ability to easily determine a combination of RH and absolute temperature to provide a desired level of personal comfort.

The inventors provide herein a new paradigm for controlling a climate control system to maintain a desired personal comfort level. Rather than require the individual to maintain personal comfort by independently adjusting multiple environmental parameters, e.g. absolute temperature and humidity, the climate control system controls such parameters to maintain a selected apparent temperature. The system determines a suitable combination of absolute temperature and/or RH and controls system components as necessary to achieve the desired combination. This control may be transparent to the user, who as mentioned previously may be uninterested in the particular combination of absolute temperature and humidity that results in the desired comfort level.

FIG. 1 illustrates a climate control system 100 according to an illustrative nonlimiting embodiment. The system 100 is described as an HVAC system associated with a residential building, without limitation thereto. Those skilled in the pertinent art are able to apply the principles disclosed herein to other climate control systems, e.g. commercial HVAC systems, rooftop HVAC systems and automotive climate control systems.

The system 100 includes a controller 110, an outdoor unit (OU) 120 and an indoor unit (IU) 130. The controller 110 may be referred to synonymously herein as a user interface (UI) 110. The controller 110 is configured to control the OU 120 and the IU 130, and may be configured to appear similar to a conventional wall-mounted thermostat. See, e.g. U.S. Patent Application No. 2010/0101854, incorporated herein by reference in its entirety. The controller 110 communicates via a bidirectional communication bus 140 with the OU 120, IU 130, and other components as described further below.

The communication bus 140 may be any suitable wired or wireless network. In some embodiments, the network is an RSBus network as described in U.S. Patent Application No. 2010/0106320 (the '320 application), incorporated herein by reference in its entirety. Such a system provides a protocol for addressed communication between networked devices. In other embodiments the bus 140 is a 4-wire system such as an RYWG 24-volt control system. In embodiments using a heat pump system, the bus 140 may be, e.g. a 7-wire control system.

The OU 120 and the IU 130 may be conventional. The OU 120 includes a compressor 120-1 and a condenser (not shown). The IU 130 includes an evaporator 130-1 and a furnace 130-2. The compressor 120-1 and the evaporator 130-1 are configured to cool air passing through the IU 130, thereby operating as a cooling source. The furnace 130-2 is configured to warm air passing through the IU 130, thereby operating as a heating source. The IU 130 may thereby heat and/or cool air enclosed within the associated building.

The controller 110 is configured to receive an apparent temperature set point and to operate the compressor 120-1 and the furnace 130-2 to maintain the set point. Maintaining the set point includes at least actively controlling an absolute temperature of the indoor space, and in some embodiments also includes actively controlling the RH of the indoor space.

The system 100 may include a humidifier 160 and/or a dehumidifier 170. The controller 110 may control the humidifier 160 and/or the dehumidifier 170 as described below to maintain a selected RH within the conditioned space. In other embodiments, the evaporator 130-1 may provide dehumidification, e.g. by undercooling. Such dehumidification may include, e.g. reducing airflow over the evaporator 130-1 to increase the residence time of the air in contact with the evaporator coils. In some embodiments the humidifier 160 may be omitted, such as when natural sources of humidity provide sufficient moisture to the enclosed space of the building. In such embodiments the controller 130 may select an absolute temperature that provides a desired apparent temperature with the naturally generated humidity level.

The controller 110 receives environmental data from a comfort sensor (CS) 150. The CS 150 includes a temperature sensor 150-1 and a relative humidity (RH) sensor 150-2. While shown as collocated in the figure, the sensors 150-1, 150-2 may be spatially separated, may be enclosed in separate enclosures, and may be independently addressed via the communication bus 140. The temperature sensor 150-1 senses the absolute temperature of the air in the enclosed space conditioned by the system 100. The RH sensor 150-2 senses the RH of the air. In some embodiments the sensors 150-1 and 150-2 report the temperature and RH to the controller 110 via the bus 140, e.g. upon receiving a request from the controller 110. In other embodiments the sensors 150-1, 150-2 are collocated with the controller 110 and bypass the bus 140 to communicate directly with the controller 110.

The comfort sensor 150 may also in some embodiments include an airspeed sensor 150-3 and a radiant energy sensor 150-4. These sensors may be used in some embodiments, described below, to enhance the capability of the comfort sensor 150 to report various environmental conditions that may affect the perceived comfort of an occupant.

The controller 110 is capable of executing various control and computational algorithms. The controller 110 in FIG. 1 is described by a control layer. As described below, the controller 110 may include a microcontroller and memory to implement the control layer for such operation. The control layer includes control blocks as follows. A user input block 110-1 receives and parses input from, e.g. a keypad or touch screen. Among various control inputs that may be provided to the controller 110 via the user input block 110-1 is an apparent temperature set point. A display control block 110-2 formats data, e.g. an apparent temperature, for presentation to an operator. A cooling/heating control block 110-3 provides control of the OU 120 and the IU 130 to cool or heat the enclosed space as described below. A humidity control block 110-4 controls operation of the humidifier 160 and the dehumidifier 170 to maintain an RH of the enclosed space. An apparent temperature control block 110-6 coordinates operation of the cooling/heating block control 110-3 and the humidity control block 110-4 to maintain the apparent temperature set point. This aspect is described in detail below.

Various sources may dynamically contribute to the moisture within the conditioned space. In a humid location, for instance, moisture from outside air may intrude into the conditioned space. Conversely, moisture from the conditioned space may be lost to the environment in an arid location. Also, the occupants of a building, appliances and activities such as cooking may contribute significantly to both the absolute temperature and humidity of the conditioned space. To effectively maintain a personal comfort level, the climate control system 100 accommodates such heat and moisture variations by actively adding or removing heat and/or moisture to the conditioned space as necessary to maintain desired absolute temperature and RH set points. Unlike a conventional system, which may for example control RH to a specific value, the system 100 may allow the absolute temperature and RH to change while maintaining the apparent temperature set point. This approach may reduce over-controlling the absolute temperature and RH, and reduce operating costs by avoiding, e.g. unnecessary dehumidification.

Figure 2:
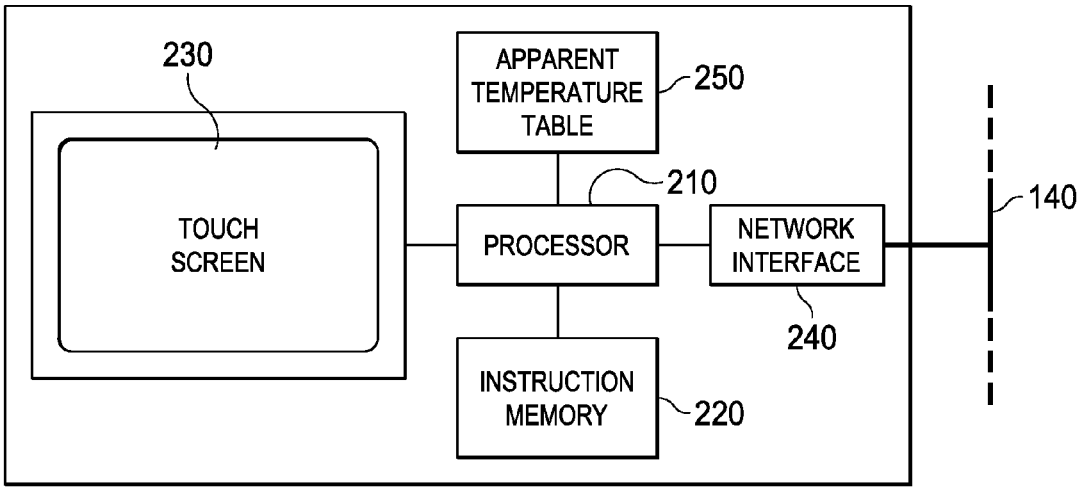
FIG. 2 illustrates an embodiment of a physical layer of the user interface of FIG. 1.

FIG. 2 illustrates a physical layer of the controller 110 in one illustrative and nonlimiting embodiment. The controller 110 includes a processor 210 and an instruction memory 220. The processor 210 may be any conventional or unconventional type of processor, including, e.g. a microprocessor, a microcontroller or a state machine, and may include any combination of discrete logic, analog components and passive components configured to provide or support the control functions described herein. The instruction memory 220 may be any type of volatile or nonvolatile memory capable of storing instructions to support the control functions implemented by the controller 210. Examples include without limitation static RAM, dynamic RAM, flash memory and programmable read-only memory (PROM). While the controller 210 and the memory 220 are shown as separate components, they may be portions of a single integrated device.

A touch screen 230 provides input to and receives output from the controller 210. An operator may, e.g. enter a desired apparent temperature set point to the controller 110 via the touch screen 230. The processor 210 may display on the touch screen 230 a current apparent temperature set point and/or a current apparent temperature as determined from the measured absolute temperature and the RH. In other embodiments, the display and input functions of the touch screen are respectively provided instead by a separate keypad and screen.

A network interface 240 provides an electrical interface between the processor 210 and the communication bus 140. The interface 240 may include any combination of analog, digital, discrete and/or integrated components to provide interfacing functions. Without limitation, one embodiment of the network interface is described in the '320 application.

A memory 250 may include tabular data associating a selected apparent temperature with one or more combinations of an absolute temperature and an RH level, as described further below. The memory 250 is not limited to any particular type, but may be, e.g. a PROM. While shown as a separate component, the memory 250 may be a portion of the memory space provided by the instruction memory 220, or may be embedded within the processor 210.

Figure 3:
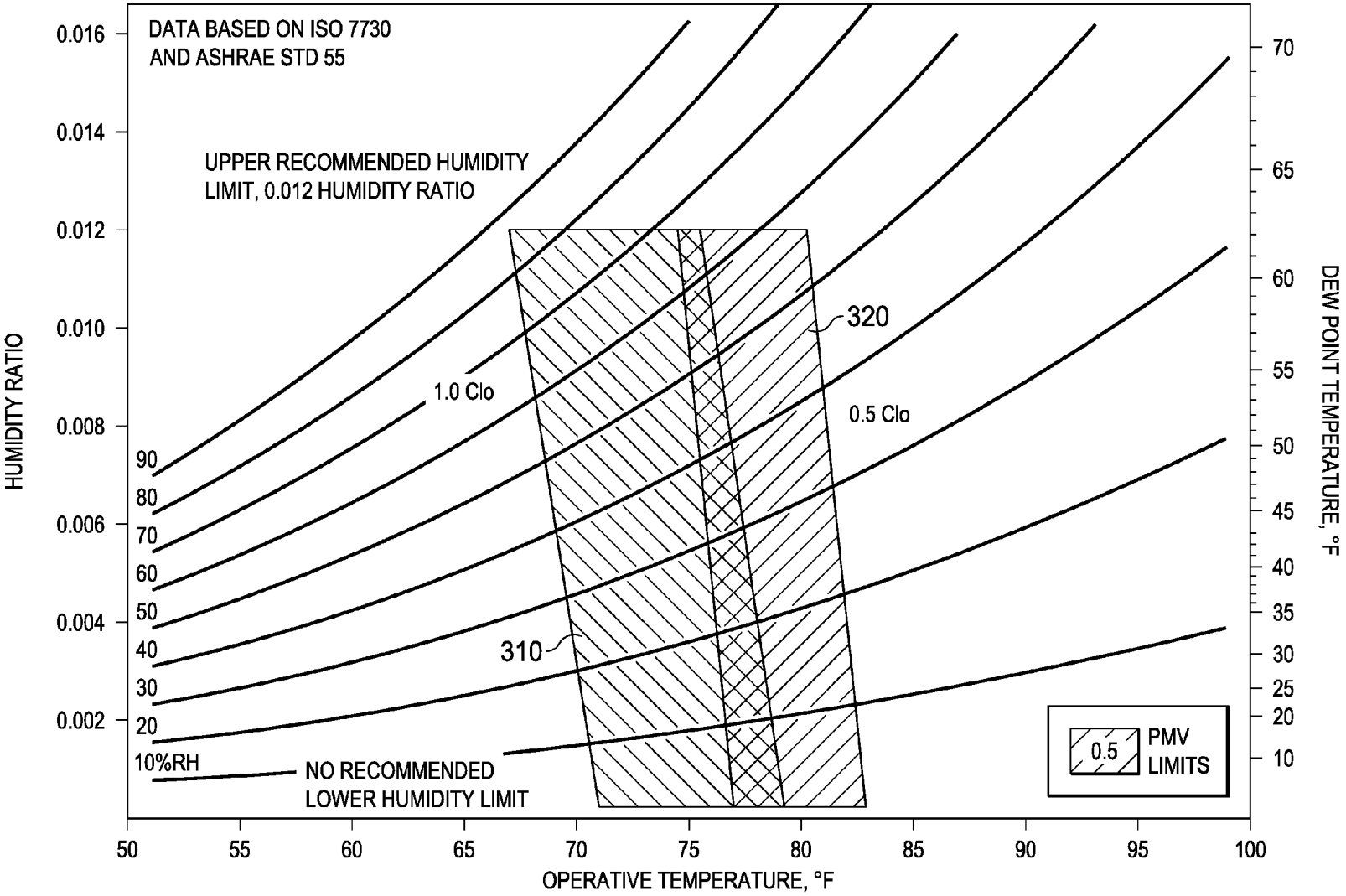
FIG. 3 is a graphical representation according to one embodiment of a range of absolute temperature and relative humidity that provides a comfortable ambient to a building occupant.

FIG. 3 presents an illustrative and nonlimiting graphical representation of one scheme for relating perceived comfort to absolute temperature and RH. This scheme is described in, e.g. in ASHRAE STD 55 §5.2, incorporated herein by reference. Two shaded quadrilateral areas 310, 320 represent ranges of absolute temperature and RH that are associated with occupant comfort of a conditioned space. The area 310 represents the case of such persons wearing clothing with an effective insulation value of 1.0 clo. The area 320 represents the case of the persons wearing clothing with an effective insulation value of 0.5 clo. Within each shaded area 310, 320 about 90% of persons are expected to report feeling neither too hot nor too cool (neutral) on a seven-point thermal sensation scale.

Either or both of the areas 310 and 320 may be represented in a format readable by the processor 210 in various embodiments described herein. For example, the area 310 may be described by the absolute temperature and RH at each corner of the quadrilateral corresponding to the area 310. Alternatively or in combination, ranges of comfortable absolute temperatures on each RH curve that intersects the area 310 may be determined and tabulated. If desired, a separate tabulation may be determined for each of the areas 310, 320. In some embodiments a tabulation associated with a lower clothing insulation value, e.g. the area 320, is used in summer months, while a tabulation associated with a higher clothing insulation value, e.g. the area 310, is used in winter months.

In some embodiments, an equation may be determined that predicts a perceived temperature, e.g. the apparent temperature $T_a$. For example, Equation 1 below, attributed to Steadman (1994), predicts the apparent temperature AT (in ° C.) perceived by an individual as a function of absolute temperature (in ° C.) and RH. (See, e.g. www.bom.gov.au/info/thermal_stress.)

$$AT=T_a+0.33\cdot(RH/100\cdot 6.105*\exp(17.27\cdot T_a/(237.7-T_a)))-4.00 \quad (1)$$

In some embodiments the parameters of Eq. 1 or a similar equation may be embedded in operating instructions of the processor 210, enabling the processor 210 to directly compute a value of the apparent temperature from the measured $T_a$ and RH. In some embodiments Eq. 1 or a similar equation may be used to generate tabular data that are then stored in the memory 250. For example, Table I presents an illustrative and nonlimiting example of such tabular temperature data, determined from Eq. 1 for a range of absolute temperature consistent with expected operation of the system 100 in some embodiments.

TABLE I

| | Absolute Temperature | | | | | | | | | | | | |
|---|---|---|---|---|---|---|---|---|---|---|---|---|---|
| RH | 68 | 69 | 70 | 71 | 72 | 73 | 74 | 75 | 76 | 77 | 78 | 79 | 80 |
| 0 | 61 | 62 | 63 | 64 | 65 | 66 | 67 | 68 | 69 | 70 | 71 | 72 | 73 |
| 5 | 61 | 63 | 64 | 65 | 66 | 67 | 68 | 69 | 70 | 71 | 72 | 73 | 74 |
| 10 | 62 | 63 | 64 | 65 | 66 | 67 | 68 | 70 | 71 | 72 | 73 | 74 | 75 |
| 15 | 63 | 64 | 65 | 66 | 67 | 68 | 69 | 70 | 72 | 73 | 74 | 75 | 76 |
| 20 | 64 | 65 | 66 | 67 | 68 | 69 | 70 | 71 | 72 | 74 | 75 | 76 | 77 |
| 25 | 64 | 65 | 67 | 68 | 69 | 70 | 71 | 72 | 73 | 74 | 76 | 77 | 78 |
| 30 | 65 | 66 | 67 | 68 | 70 | 71 | 72 | 73 | 74 | 75 | 77 | 78 | 79 |
| 35 | 66 | 67 | 68 | 69 | 70 | 72 | 73 | 74 | 75 | 76 | 78 | 79 | 80 |
| 40 | 66 | 68 | 69 | 70 | 71 | 72 | 74 | 75 | 76 | 77 | 79 | 80 | 81 |
| 45 | 67 | 68 | 69 | 71 | 72 | 73 | 74 | 76 | 77 | 78 | 80 | 81 | 82 |
| 50 | 68 | 69 | 70 | 71 | 73 | 74 | 75 | 77 | 78 | 79 | 80 | 82 | 83 |
| 55 | 68 | 70 | 71 | 72 | 74 | 75 | 76 | 77 | 79 | 80 | 81 | 83 | 84 |
| 60 | 69 | 70 | 72 | 73 | 74 | 76 | 77 | 78 | 80 | 81 | 82 | 84 | 85 |
| 65 | 70 | 71 | 72 | 74 | 75 | 76 | 78 | 79 | 81 | 82 | 83 | 85 | 86 |
| 70 | 70 | 72 | 73 | 75 | 76 | 77 | 79 | 80 | 82 | 83 | 84 | 86 | 87 |
| 75 | 71 | 73 | 74 | 75 | 77 | 78 | 80 | 81 | 82 | 84 | 85 | 87 | 88 |
| 80 | 72 | 73 | 75 | 76 | 77 | 79 | 80 | 82 | 83 | 85 | 86 | 88 | 89 |
| 85 | 73 | 74 | 75 | 77 | 78 | 80 | 81 | 83 | 84 | 86 | 87 | 89 | 90 |
| 90 | 73 | 75 | 76 | 78 | 79 | 81 | 82 | 84 | 85 | 87 | 88 | 90 | 91 |
| 95 | 74 | 75 | 77 | 78 | 80 | 81 | 83 | 84 | 86 | 88 | 89 | 91 | 92 |
| 100 | 75 | 76 | 78 | 79 | 81 | 82 | 84 | 85 | 87 | 89 | 90 | 92 | 94 |

The personal comfort model may also in some embodiments include other comfort characteristics. For example, as described above the comfort sensor 150 may include the airspeed sensor 150-3 and the radiant energy sensor 150-4. ASHRAE STD 55 describes inclusion of the radiant energy (RE) and airspeed (AS) in a model of apparent temperature. Such a model may be generally expressed as $$AT=f(T_a,RH,RE,AS).$$

For example, radiant energy from, e.g. windows or appliances may not be perceived by the temperature sensor 150-1, but heat absorbed by an occupant's body may cause the occupant to perceive a higher temperature than would otherwise be the case. Moreover, moving air may cool the occupant, lowering the perceived temperature. The airspeed sensor 150-3 and the radiant energy sensor 150-4 provide a measure of these comfort characteristics to the user interface 110. In some embodiments the airspeed sensor 150-3 and/or the radiant energy sensor 150-4 are portable units that may be collocated with the occupant to accurately reflect the microenvironment the occupant experiences. In some embodiments the airspeed sensor 150-3 and/or the radiant energy sensor 150-4 are wirelessly connected to the user interface 110 via a wireless extension of the communication bus 140 to enable greater portability.

Figure 4A:
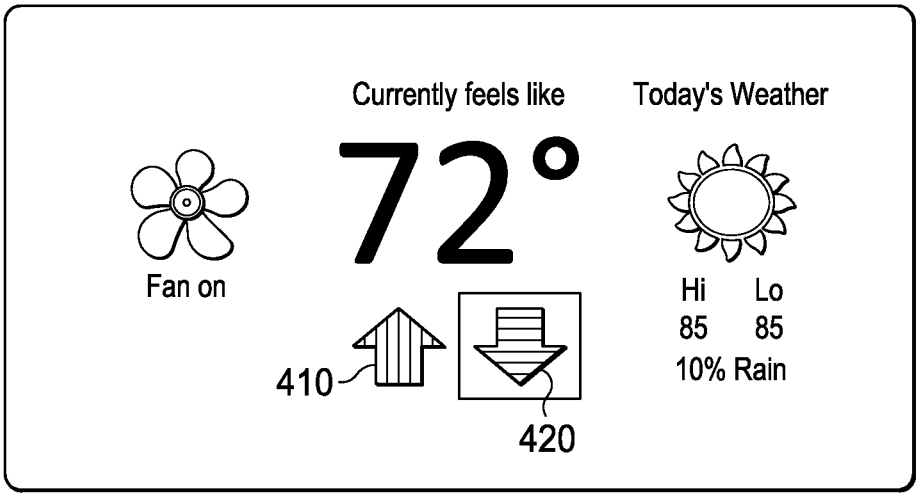
FIGS. 4A and 4B illustrate examples of a user interface display during operation of the system of FIG. 1 to transition from one apparent temperature set point to another apparent temperature set point.

FIG. 4A shows an illustrative nonlimiting embodiment of a display configuration of the touch screen 230. The touch screen 230 displays an apparent temperature under the text "Currently feels like", in this example 72° C. (~22.2° C.). Absent from the screen is any display of the current absolute temperature or RH. While the scope of the claims includes embodiments that include one or both of the absolute temperature and RH, the embodiment of FIG. 4A advantageously presents an uncluttered display of the apparent ("feels like") temperature, which in many cases is the parameter the operator most cares about. An up arrow 310 allows an operator to increment the apparent temperature set point of the system 100, while a down arrow 420 allows the operator to decrement the apparent temperature set point. In FIG. 4A the down arrow 420 includes an unreferenced outline, indicating that this arrow has been recently selected to effect a change of the system 100 control set point. FIG.

4B illustrates the touch screen 230 after the indicated apparent temperature has stabilized at the selected value, e.g. 71° F.

FIG. 5 presents a method 500 of operating the system 100 in an illustrative nonlimiting embodiment. The method 500 is described with reference to the system 100, without limitation thereto. The steps of the method 500 may be performed in another order than that shown, and the method may include steps other than the illustrated steps. The method 500 is also described with reference to FIGS. 4A and 4B to illustrate a nonlimiting example. In FIG. 4A the operator has recently decremented the apparent temperature, as indicated by the box drawn around the down arrow 420.

The method 500 begins with a step 501, such as a subroutine entry point called upon the activation of the down arrow 420. In a step 510 the processor 210 receives the apparent temperature set point entry from the touch screen 230. In a step 520 the controller 130 determines one or more combinations of actual temperature and RH that result in an apparent temperature about equal to the apparent temperature set point. The method 500 then advances to a decisional step 530.

In the step 530 the controller 110 determines if there is at least one solution within a preferred RH range, e.g. between about 40% and about 60%. The controller 110 may be configured to allow the operator to input the preferred RH range via a setup screen, or this range may be programmed by the manufacturer. If the controller 110 determines there is at least one such solution within the preferred RH range the method 500 advances to a decisional step 540. In the step 540 the controller 110 determines if there are multiple solutions in the preferred RH range. It is apparent by inspection of Table I that in some cases multiple combinations of $T_a$ and RH may produce a same apparent temperature. If there are multiple solutions the method 500 advances to a step 550. In the step 550 the controller 110 selects the solution that has an RH that is closest to the current RH as reported by the RH sensor 150-2. The method 500 then advances to a step 560 in which the controller 110 controls for the selected $T_a$ and RH.

If in the step 530 the controller 110 determines that there is not at least one solution within the preferred RH range, the controller 110 selects the solution with an RH closest to the upper or lower limit of the preferred range, e.g. 60% or 40%. For example, if the RH prior to the new apparent temperature set point is less than 40%, the controller may select a combination of $T_a$ and RH that results in the desired apparent temperature while providing an RH as close to 40% as possible. The method then advances to the step 560 and controls for the selected solution.

If in the step 540 the controller determines there are not multiple solutions in the preferred RH range, the method 500 advances to a step 580. In the step 580 the controller selects the unique solution within the preferred RH range. The method 500 advances to the step 560 and controls for the selected solution. The method ends with a return step 599 that returns, e.g. to a calling master control routine.

Figure 4B:
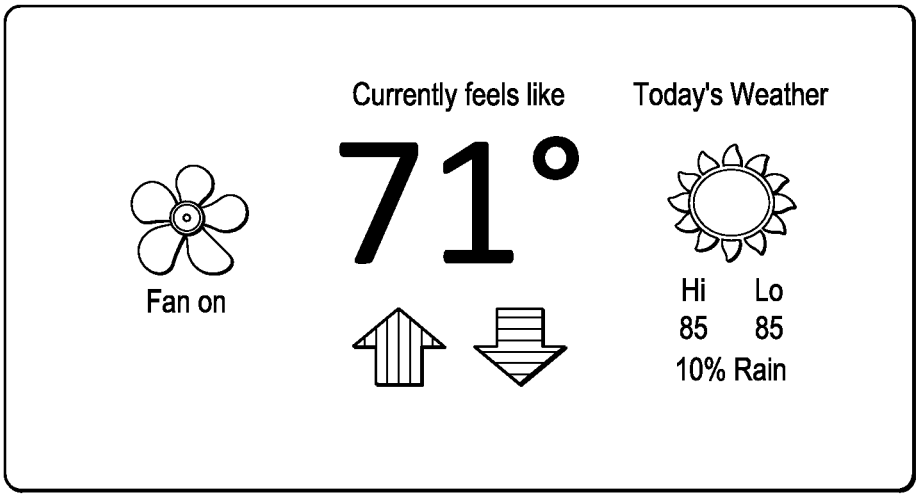

Returning to the example of the apparent temperature set point change in FIGS. 4A and 4B, two cases are described. For the purpose of discussion, it is assumed that the apparent temperature set point is initially 72° F. (~22.2° C.), the new apparent temperature set point is 71° C. (~21.7° C.), and the preferred RH range is about 40% to about 60%.

In a first illustrated case, the $T_a$ and RH are initially 73° F. (~22.8° C.) and 35%, respectively prior to the change of apparent temperature. Referring to Table I, two possible combinations of $T_a$ and RH that result in an apparent temperature of 71° F. are 72° F./40% and 74° F. (23.3° C.)/25%. Referring to the method 500 without limitation, the former combination is selected, because the RH is within the preferred range of 40%-60% RH.

In a second illustrative case, the RH at the initial absolute temperature set point of 72° F. is about 60%. Again referring to Table I, the absolute temperature that corresponds to an apparent temperature $T_a$ of 72° F. at 60% RH is about 70° F. At the new apparent temperature set point of 71° F. (FIG. 4B) the absolute temperature may be about 69° F. at about 65% RH, or about 71° F. at about 45-50% RH. In this case the method 500 will select the solution at 71° F. and 45-50% RH, since the RH is in the preferred range.

In both of these illustrative cases, the controller 110 operates the system 100 to maintain an apparent temperature of the conditioned space at 71° F. after the set point is reduced. However, the absolute temperature may differ from the displayed apparent temperature set point. In the first case, the displayed apparent temperature set point is 71° F., while the absolute temperature is 72° F. This feature is contrary to known climate control methods and systems, for which the system controller operates the climate control system to maintain an absolute temperature that is equal to a displayed temperature set point.

FIG. 6 shows an illustrative and nonlimiting embodiment of the display 230 in which the numeric display of $T_a$ is replaced with a non-alphanumeric representation, or icon, 610. The icon 610 is shown without limitation as a figure representing a house. The icon 610 may conveniently represent a comfort setting appropriate for times the conditioned space is occupied. Because the apparent temperature displayed, e.g. in FIG. 4A, does not necessarily reflect the absolute temperature of the conditioned space, the numeric display of FIG. 4A may be replaced with the more symbolic representation of the apparent temperature provided by the icon 610 without significant loss of information. For many users, an abstract representation may be sufficient or even desirable, as many users are interested in perceived comfort rather than the particular combination of $T_a$ and RH selected by the controller 110. The icon 610 may therefore be designed to provide other information that may be more immediately relevant to the operator, such as which of several programmable time-of-day set points the controller 130 is using.

As an example, FIG. 7 illustrates another display 700, referred to without limitation as "FeelsLike™ Comfort Control Programming". In this embodiment programmable time periods during a representative week may be programmed for weekdays (Monday-Friday) and the weekend (Saturday-Sunday). Weekdays and weekends are divided into four time ranges, and the apparent temperature may be independently programmed for each time range. Without limitation, three icons are shown in addition to the home icon 610. A "wake time" icon 710 may represent an apparent temperature that a user selects for a time the user may arise in the morning. An "away" icon 720 may represent an apparent temperature selected by the user for use when the building is unoccupied. And a "bedtime" icon 730 may represent the apparent temperature selected by the user for sleeping hours. Of course other icons, time periods, and number of time periods may be selected and remain within the scope of the disclosure.

In some embodiments (not shown), the space conditioned by the system 100 is one of a plurality of zones in a conditioned building. For example, the controller 110 may be located in a first zone that includes bedrooms of a home. An occupant of a bedroom may select an apparent temperature that is subjectively more comfortable for sleeping via the controller 110 within that zone. The described capabilities of the system 100 allow the occupant to easily adjust the apparent temperature set point by numeric value or by symbolic icon for comfortable sleeping. An occupant of a second zone including, e.g. common areas of the home, may adjust the apparent temperature of the second zone independently of the first zone. Such control may be, e.g. via the controller 100 or a second controller.

Turning to FIG. 8, a method 800 is illustrated for manufacturing a climate control system in a nonlimiting illustrative embodiment. The method 800 is described without limitation with reference to features previously described with respect to the system 100, e.g. in FIGS. 1-8. The steps of the method 800 may be performed in another order than the illustrated order, and in some embodiments may not be performed at all.

In a step 810 a cooling source and/or a heating source are configured to respectively cool and heat an enclosed space. In a step 820 a controller is configured to receive an apparent temperature set point. The controller is further configured to operate the cooling and/or heating sources to maintain an absolute air temperature with the enclosed space that is different from the apparent temperature set point.

In a step 830 the controller is further configured to maintain a relative humidity that, in combination with the absolute temperature, results in the apparent temperature. In a step 840 the controller is configured to maintain the relative humidity by undercooling the enclosed space. In a step 850 the controller is configured to maintain the relative humidity by operating a humidifier.

In a step 860 the controller is configured to display the apparent temperature set point. In a step 870 the controller is configured to display a non-alphanumeric icon representative of the apparent temperature set point.

In a step 880 the controller is configured to control the cooling and/or heating sources via a bidirectional communication bus.

In a step 890 the controller is configured to control both absolute temperature and relative humidity to maintain the apparent temperature.

Those skilled in the art to which this application relates will appreciate that other and further additions, deletions, substitutions and modifications may be made to the described embodiments.

What is claimed is:

1. A climate control system, comprising:

a cooling source, including a compressor, configured to cool an enclosed space;

a heating source, including a furnace, configured to heat the enclosed space; and a controller coupled to the cooling source and the heating source, the controller configured to:

receive a first apparent temperature set point, a second apparent temperature set point, a first time, and a second time, the first apparent temperature set point different from the second apparent temperature set point, the first time different from the second time;

receive a first measured relative humidity of the enclosed space at the first time, a first measured air speed in the enclosed space at the first time, and a first measured radiant energy of the enclosed space at the first time;

receive a second measured relative humidity of the enclosed space at the second time, a second measured air speed in the enclosed space at the second time, and a second measured radiant energy of the enclosed space at the second time;

determine a first plurality of combinations of absolute air temperature, air speed, radiant energy, and relative humidity, wherein the absolute air temperature, air speed, radiant energy, and the relative humidity of each combination of the first plurality of combinations correspond to the received first apparent temperature set point;

determine a second plurality of combinations of absolute air temperature, air speed, radiant energy, and relative humidity, wherein the absolute air temperature, air speed, radiant energy, and the relative humidity of each combination of the second plurality of combinations correspond to the received second apparent temperature set point;

determine if a first current time is the first time;

in response to a determination that the first current time is the first time:

determine a combination of the first plurality of combinations wherein the relative humidity of the determined combination of the first plurality of combinations is closer to the measured relative humidity of the enclosed space than the relative humidities of the other combinations of the first plurality of combinations; and operate the cooling source, including the compressor, and the heating source, including the furnace, to maintain an absolute air temperature within the enclosed space at the absolute air temperature of the determined combination of the first plurality of combinations;

determine if a second current time is the second time; and in response to a determination that the second current time is the second time:

determine a combination of the second plurality of combinations wherein the relative humidity of the determined combination of the second plurality of combinations is closer to the measured relative humidity of the enclosed space than the relative humidities of the other combinations of the second plurality of combinations; and operate the cooling source, including the compressor, and the heating source, including the furnace, to maintain an absolute air temperature within the enclosed space at the absolute air temperature of the determined combination of the second plurality of combinations.

2. The system as recited in claim 1, wherein the controller is further configured to maintain a relative humidity within the enclosed space at the relative humidity of the determined combination of the first plurality of combinations.

3. The system as recited in claim 2, wherein the controller maintains the relative humidity within the enclosed space by reducing airflow over an evaporator of the climate control system.

4. The system as recited in claim 1, wherein said controller displays said apparent temperature set point.

5. The system as recited in claim 1, wherein said controller selects said one of said combinations based on said relative humidities and a measured relative humidity of said enclosed space.

6. The system as recited in claim 1, wherein said controller selects said one of said combinations based on said relative humidities, a relative humidity range, and a measured relative humidity of said enclosed space.

7. A method of manufacturing a climate control system, comprising:

configuring a cooling source, including a compressor, to cool an enclosed space;

configuring a heating source, including a furnace, to heat the enclosed space;

configuring a controller to:

receive a first apparent temperature set point, a second apparent temperature set point, a first time, and a second time, the first apparent temperature set point different from the second apparent temperature set point, the first time different from the second time;

receive a first measured relative humidity of the enclosed space at the first time, a measured air speed in the enclosed space at the first time, and a measured radiant energy of the enclosed space at the first time;

receive a second measured relative humidity of the enclosed space at the second time, a second measured air speed in the enclosed space at the second time, and a second measured radiant energy of the enclosed space at the second time;

determine a first plurality of combinations of absolute air temperature, air speed, radiant energy, and relative humidity, wherein the absolute air temperature, air speed, radiant energy, and the relative humidity of each combination of the first plurality of combinations correspond to the received first apparent temperature set point;

determine a second plurality of combinations of absolute air temperature, air speed, radiant energy, and relative humidity, wherein the absolute air temperature, air speed, radiant energy, and the relative humidity of each combination of the second plurality of combinations correspond to the received second apparent temperature set point;

determine if a first current time is the first time;

in response to a determination that the first time is the first time:

determine a combination of the first plurality of combinations wherein the relative humidity of the determined combination of the first plurality of combinations is closer to the measured relative humidity of the enclosed space than the relative humidities of the other combinations of the first plurality of combinations; and operate the cooling source, including the compressor, and the heating source, including the furnace, to maintain an absolute air temperature within the enclosed space at the absolute air temperature of the determined combination of the first plurality of combinations;

determine if a second current time is the second time; and in response to a determination that the second current time is the second time:

determine a combination of the second plurality of combinations wherein the relative humidity of the determined combination of the second plurality of combinations is closer to the measured relative humidity of the enclosed space than the relative humidities of the other combinations of the second plurality of combinations; and operate the cooling source, including the compressor, and the heating source, including the furnace, to maintain an absolute air temperature within the enclosed space at the absolute air temperature of the determined combination of the second plurality of combinations.

8. The method as recited in claim 7, wherein the controller is further configured to maintain a relative humidity within the enclosed space at the relative humidity of the determined combination of the first plurality of combinations.

9. The method as recited in claim 8, wherein the controller maintains the relative humidity within the enclosed space by reducing airflow over an evaporator of the climate control system.

10. The method as recited in claim 7, wherein said controller displays said apparent temperature set point.

11. The method as recited in claim 7, wherein said controller is configured to select said one of said combinations based on said relative humidities and a measured relative humidity of said enclosed space.

12. The method as recited in claim 7, wherein said controller is configured to select said one of said combinations based on said relative humidities, a relative humidity range for said enclosed space, and a measured relative humidity of said enclosed space.

* * * * *